United States Patent [19]

McMaster

[11] Patent Number: 4,799,870

[45] Date of Patent: Jan. 24, 1989

[54] FLUID POWER TRANSFER DEVICE

[76] Inventor: Harold A. McMaster, 707 Riverside Dr., Woodville, Ohio 43469

[21] Appl. No.: 6,378

[22] Filed: Jan. 23, 1987

[51] Int. Cl.[4] ..... F01C 1/12; F01C 3/08; F01C 1/344

[52] U.S. Cl. ..... 418/151; 418/193; 418/195

[58] Field of Search ..... 418/193, 195, 68, 151, 418/194

[56] References Cited

U.S. PATENT DOCUMENTS

| | | | |
|---|---|---|---|
| 2,242,058 | 5/1941 | Cuny | 418/193 |
| 2,482,325 | 9/1949 | Davis | 418/193 |
| 2,525,907 | 10/1950 | Johnston | 418/193 |
| 2,681,046 | 6/1954 | Barrett | 418/193 |
| 2,828,695 | 4/1958 | Marshall | 418/193 |
| 3,040,664 | 6/1962 | Hartley | 418/193 |
| 3,093,961 | 6/1963 | Pisa | 418/193 |
| 3,277,792 | 10/1966 | Stenerson | 418/193 |
| 3,528,242 | 9/1970 | Hartmann | 418/193 |
| 3,556,696 | 1/1971 | Bertoni | 418/68 |
| 3,847,515 | 11/1974 | Caldwell | 418/193 |
| 4,519,756 | 5/1985 | Fenton | 418/68 |

FOREIGN PATENT DOCUMENTS 2064429 1/1972 Fed. Rep. of Germany .

*Primary Examiner*—John J. Vrablik

*Attorney, Agent, or Firm*—Brooks & Kushman

[57] ABSTRACT

A fluid power transfer device includes a pair of rotors and vanes mounted for rotation in a hollow housing having an equatorial plane wherein conical faces of the rotors rollingly engage each other to form a line contact and wherein a hinge pin which hingedly connects the vanes is constrained to rotate in the equatorial plane of the housing. A sun gear sector is connected to the side of each vane opposite the hinge pin. A ring gear sector is connected to the inner end of each output shaft to rotate therewith. A pinion planet gear connects each ring gear sector to each sun gear sector so that the pinion planet gears rock back and forth between their respective sectors as the vanes rock about the hinge pin. The pinion planet gears are elongated and confine the hinge pin to the equatorial plane. The pinion planet gears also act as splines to transfer torque. Each rotor includes a pair of rotor portions and an interconnecting outer band. The outer bands also have conical faces which rollingly engage each other to further form the line contact. The outer bands are slidably received within grooves formed on the inner surface of the housing. Each of the hinged vanes is received and extends towards its gear sector through a channel defined by its respective rotor portions. The conical faces of the rotors and the housing cooperate to define a working chamber which is divided into working compartments by the hinged vanes and the line contact. The rotors and the vanes transfer power between their respective shafts and an operating fluid introduced into one of the working compartments.

22 Claims, 3 Drawing Sheets

FLUID POWER TRANSFER DEVICE

TECHNICAL FIELD

This invention relates to fluid power transfer devices and, in particular, to rotary fluid power transfer devices including at least one vane mounted by a shaft in a housing wherein the vane transfers power between an operating fluid introduced into the housing and the shaft.

TECHNICAL FIELD

Rotary pumps and engines are machines which have rotary elements which do work. Rotary engines include a piston which rotates in a cylinder to convert energy into mechanical force or motion. Rotary pumps include a pair of members in rotational contact to draw a fluid therein through an inlet port and force the fluid out through an exhaust port.

One well-known type of rotary engine is the Wankel engine which comprises a rotary-type internal combustion engine having a rotor and an eccentric shaft. The rotor moves in one direction around a trochoidal chamber containing peripheral inlet and exhaust ports. The rotor divides the chamber volume into three compartments.

U.S. Patents to Cobb U.S. Pat. No. 763,963; Hartley U.S. Pat. No. 3,040,664; Stevenson U.S. Pat. No. 3,277,792; Hendricks U.S. Pat. No. 764,465; and Davis U.S. Pat. No. 2,482,325 as well as German Patent Document U.S. Pat. No. 2,064,429 all disclose rotary fluid power transfer devices generally of the type to which this invention relates.

DISCLOSURE OF THE INVENTION

An object of the present invention is to provide an improved rotary, fluid power transfer device which is adapted to provide significantly more power per working displacement and significantly more working displacement per housing volume than conventional rotary devices.

Another object of the present invention is to provide an improved fluid power transfer device including at least one rotor and one vane mounted for rotation by a shaft within a spherical housing having an equatorial plane and means coupling the vane to the shaft for substantially constraining rotation of a portion of the vane to the equatorial plane of the housing.

Yet still another object of the present invention is to provide a fluid power transfer device including a pair of rotors mounted within a spherical housing having an equatorial plane and polar axes wherein vanes hingedly interconnected by hinge means cause rotation of the rotors about their respective rotor axes which are inclined to the polar axes as the shafts rotate and wherein means coupling the vanes to their respective shafts are provided for substantially constraining rotation of the hinge means to the equatorial plane of the housing.

In carrying out the above objects and other objects of the present invention, a fluid power transfer device, constructed in accordance with the present invention, comprises a spherical housing having an equatorial plane and polar axes, a shaft mounted for rotation, and a rotor received within the housing. A vane is mounted by the rotor for rotation. The rotor is mounted by the housing for rotation about a rotor axis and inclined to the polar axes. The vane causes rotation of the rotor. The rotor has a face that cooperates with the housing to at least partially define a working chamber in which an operating fluid is received. The vane extends between the rotor and the housing to divide adjacent portions of the working chamber. The device further comprises means coupling the vane to the shaft for substantially constraining rotation of a portion of the vane to the equatorial plane of the housing. The vane transfers power between the operating fluid and the shaft.

Further, in carrying out the above objects and other objects of the present invention, a fluid power transfer device, constructed in accordance with the present invention, comprises a spherical housing having an equatorial plane and polar axes and having a concave inner surface. First and second shafts extend through the housing and are mounted for rotation about first and second of the polar axes, respectively. A pair of rotors are received within the housing. Each rotor has a convex face that slides against the concave inner surface of the housing. First and second vanes and hinge means for hingedly connecting the vanes are mounted by their respective rotors for rotation. Each of the rotors is mounted by the housing for rotation about a rotor axis inclined in its respective polar axis. Each rotor has a conical face that rollingly engages the conical face of the other rotor to form a line contact and in conjunction with the housing defines a working chamber in which an operating fluid is received. The line contact and the vanes extend between the housing and the rotors to divide adjacent portions of the working chamber into working compartments. The vanes cause rotation of the rotors as their respective shafts rotate. The device further comprises means coupling the vanes to their respective shafts for substantially constraining rotation of the hinge means to the equatorial plane of the housing. the rotors and the vanes transfer power between the operating fluid and the shafts.

Preferably, each of the rotors includes a pair of rotor portions and an outer band for holding the rotor portions together. The rotor portions define a channel extending completely through its rotor for receiving its respective vane. The rotor axes pass through the center of the sphere. The outer bands preferably have conical faces which rollingly engage each other to further form the line contact.

Also, preferably the means for substantially constraining comprises gear means or linkage including a sun gear sector, a ring gear sector and a pinion planet gear which connects the sectors together.

Depending on the particular application, the device may operate, for example, as a rotary pump or as a rotary engine. When operated as a two-cycle rotary engine (i.e. without intake and compression strokes) the power stroke of the engine may be 270° in duration per 360° rotation of the shafts for each end of the vanes, thereby doubling the output power per given displacement volume. Also, by using liquid fuel and oxidant, the engine can deliver four times the power for a given displacement that a four-cycle engine would deliver. Such a rotary engine would be equivalent to a six-cylinder, four-cycle piston engine which also averages 540° of power stroke per revolution.

Also, the ration of working volume of the device to overall volume is very favorable due to its compact spherical design. An improvement by a factor of 3 to 4 is possible with the design as compared to a four-cylinder, four-cycle piston engine.

The objects, features and advantages of the present invention are readily apparent from the following detailed description of the best mode for carrying out the invention when taken in connection with the accompanying drawings.

BEST MODE FOR CARRYING OUT THE INVENTION

Figure 1:
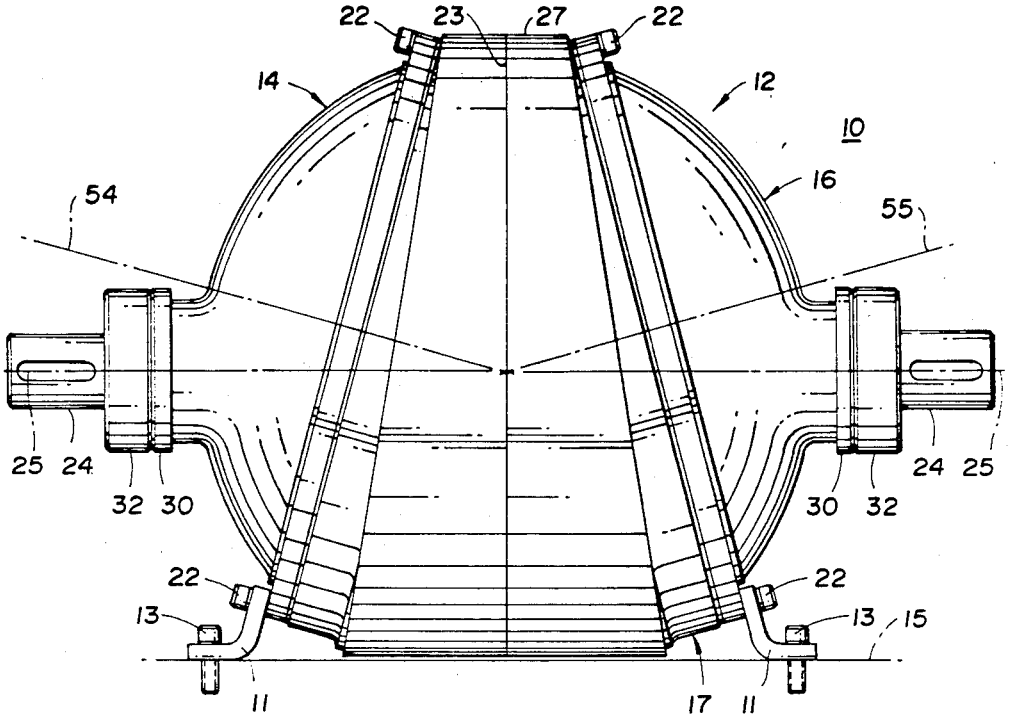
FIG. 1 is a side elevational view of a fluid power transfer device constructed in accordance with the present invention.
Figure 2:
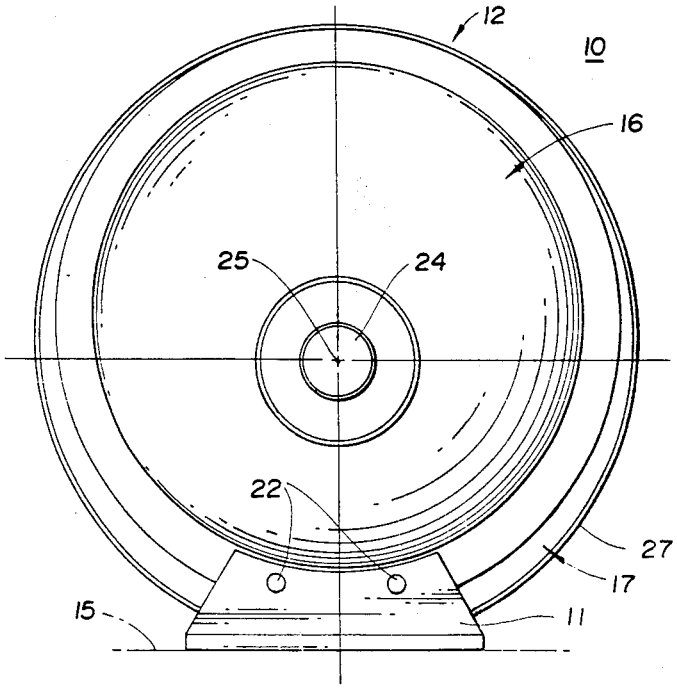
FIG. 2 is an end view of the device.

Referring now to the drawings, there is illustrated in FIGS. 1 through 4 an embodiment of a fluid power transfer device, collectively indicated by reference numeral 10, constructed in accordance with the present invention. As shown in the figures, the device 10 is specifically embodied as a rotary engine. However, the device can also be embodied, for example, as a rotary pump or other machine, as will be evident to persons skilled in this art.

The device 10 comprises a hollow, spherical housing, generally indicated at 12, including first, second and third housing sections, generally indicated at 14, 16 and 17, respectively. The housing sections 14 and 16 have concave, accurate spherical, inner surfaces 18 and 20, respectively. The third housing section 17 has a lower portion 19 which also has a concave, generally spherical smooth inner surface 21.

The housing sections 14 and 16 are bolted to the third housing section 17 by a plurality of circumferentially-spaced bolts 22 to hold the sections 14, 16 and 17 together about an equatorial plane 23. An annular cover member 27 partially covers the section 17 and is preferably clamped thereto.

The housing 12 is supported by brackets 11, each of which is connected to its respective housing section 14 or 16 and the third housing section 17 by the lowermost of the bolts 22. Bolts 13 are provided for securing the device 10 on a support surface 15.

The device 10 also includes a pair of shafts, generally indicated at 24. The shafts 24 are aligned with polar axes 25 of the housing 12. The shafts 24 extend through spaced, circular apertures 26 formed in the housing sections 14 and 16, respectively.

The shafts 24 are supported for rotation within the apertures 26 by sleeve bearings 28 and 29. An annular member 30 is mounted on the exterior surface of each of the housing sections 14 and 16 adjacent its respective shaft 24 such as by threads. A cap member 32 is supported against its respective annular member 30 and has an aperture 34 through which its respective shaft 24 extends. An annular thrust bearing 36 is mounted to the cap member 32 about the aperture 34 to further support and seal each of the shafts 24.

The device 10 further comprises a pair of rotors, generally indicated at 42, which are received in the housing 12. Each of the rotors 42 includes a pair of identical rotor portions or half cones 44 and 46 and an interconnecting outer band 48. A plurality of circumferentially spaced bolts 49 connect the outer band 48 to the rotor portions 44 and 46.

The outer bands 48 of the rotors 42 are slidably supported within grooves 50 and 52 formed by the housing sections 14, 16 and 17 by respective thrust and radial bearings 51 and 53 for rotation about their respective rotor axes 54 and 55 which pass through the center or center point of the spherical surface 21. The rotor axes 54 and 55 are shown inclined 15° with respect to the polar axes and to each other by an angle of 30°. However,it is to be understood that other angles may be used.

The outer bands 48 of the rotors 42 have convex outer surfaces or faces which slide against the bearings 51 and 53.

Each of the rotor portions 44 and 46 has a conical face 56 that rollingly engage the conical face 56 of the corresponding rotor portion 44 or 46 of the other rotor 42 and cooperates therewith to form a line contact 58 which remains stationary as the rotors 42 and the shafts 24 rotate. The concave inner surface 21 and the conical faces 56 define a working chamber 59 which is 60° wide from cone to cone opposite the line contact 58.

Each of the outer bands 48 also has a continuous conical face 60 that rollingly engages the conical face 60 of the other conical face 60 and cooperates therewith to further form the line contact 58. Each of the outer bands also acts like a flywheel while the continuous surfaces of the faces 60 prevent cogging when the vane gap of working chamber 59 goes past the line contact 58.

Figure 5:
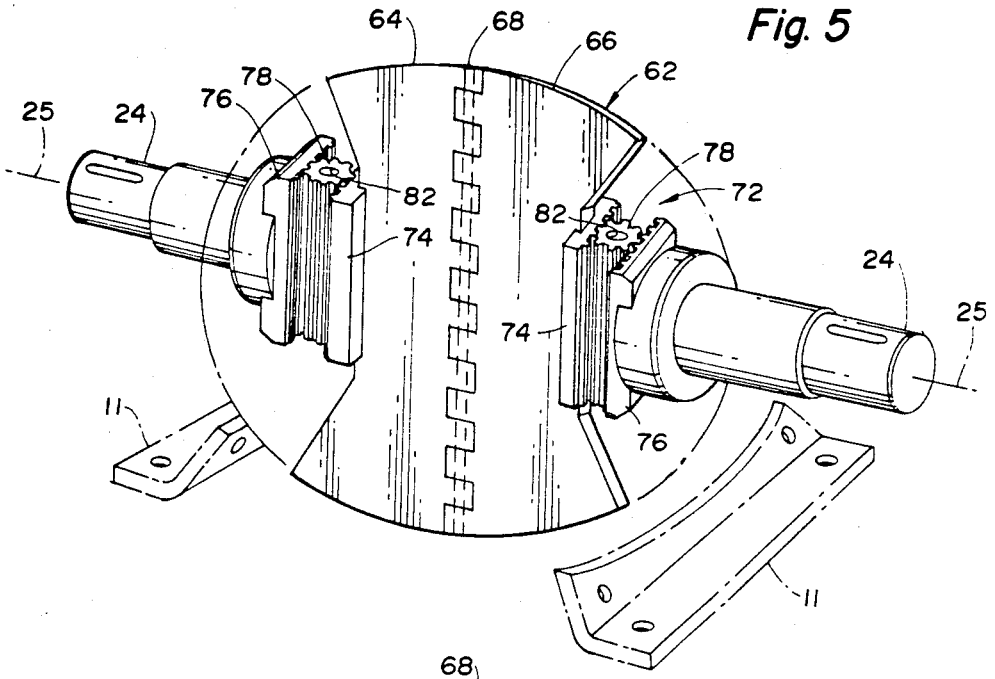
FIG. 5 is a perspective view of interconnected vanes, shafts and coupling therebetween for use in the device.
Figure 6:
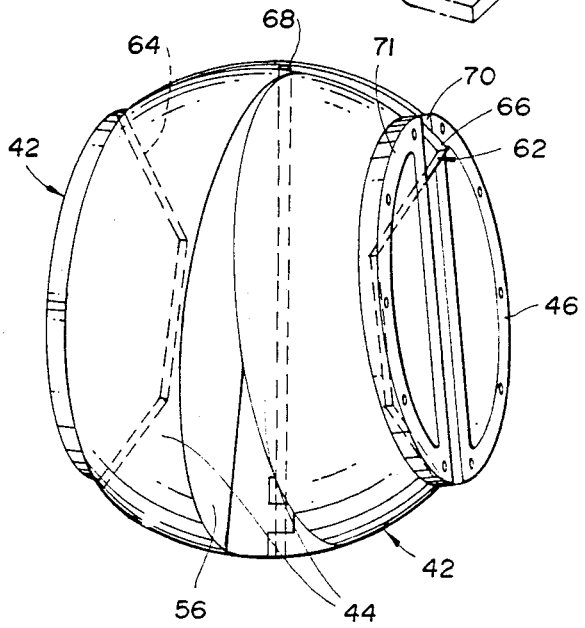
FIG. 6 is a perspective view of the interconnected vanes and their respective rotor portions.

The device 10 also includes a vane assembly, generally indicated at 62. The vane assembly 62 comprises first and second "bow-tie" shaped vanes 64 and 66, as best shown in FIG. 5, hingedly connected together by a hinge pin 68. While not shown, bushings rotatably support portions of the pin 68 in the vanes 64 and 66.

The axes 25, 54 and 55 and the center of the hinge pin 68 meet at the center point of the spherical surface 21. The vanes 64 and 66 and the line contact 58 cooperate in dividing the working chamber 59 into working compartments.

Figure 4:
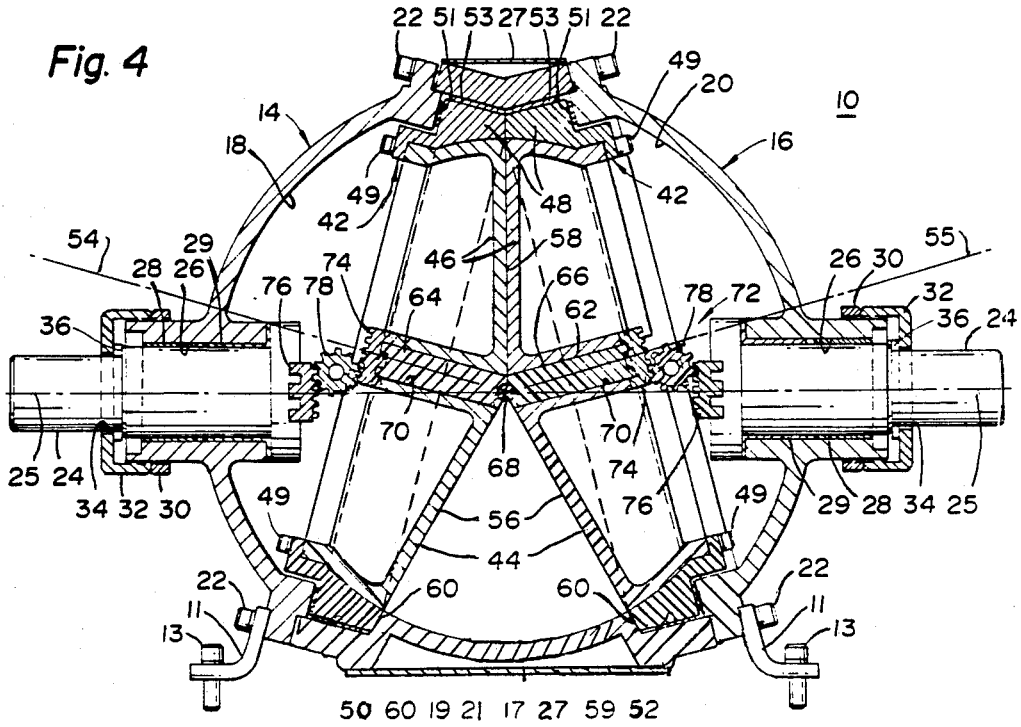
FIG. 4 is a view similar to FIG. 3 with the rotors rotated 90° from their position shown in FIG. 3.

The rotor portions 44 and 46 are spaced by the vane thickness, as best shown in FIG. 4. The vanes 64 and 66 are received and retained within channels 70 formed by the rotor portions 44 and 46 of each rotor 42. The channels 70 extend between the conical faces 56 and the outer faces 71 of the rotor portions 44 and 46.

Each of the vanes 64 and 66 is directly coupled to its respective output shaft 24. A gear means or linkage, generally indicated at 72, is provided for each of the vanes 64 and 66. Each linkage 72 includes a relatively long, convex planetary sun gear sector 74 attached to the side of its vane 64 or 66 opposite the hinge pin 68. Each linkage 72 also includes a concave ring gear sector 76 attached to the inside end of its respective shaft 24 and an elongated pinion planet gear 78 which connects the two sectors 74 and 76.

Figure 3:
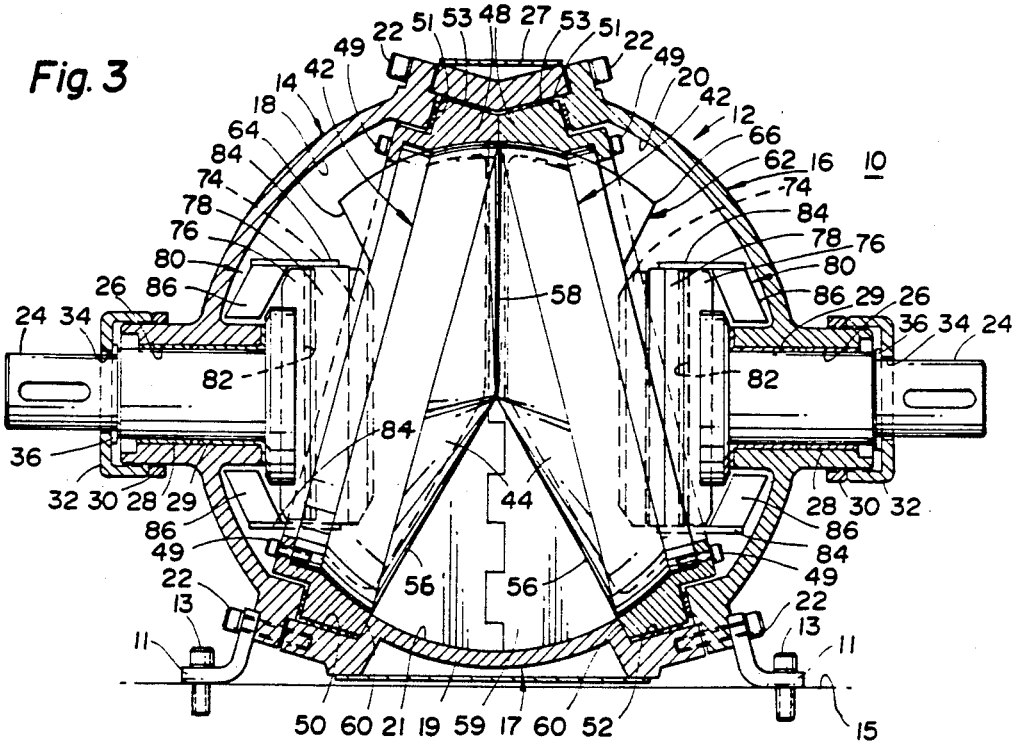
FIG. 3 is a sectional view taken through the axes of rotation and the polar axes perpendicular to the equatorial plane of the device.

A counterweight assembly, generally indicated at 80 in FIG. 3, maintains each of the planet gears 78 between the two sectors 74 and 76. Bolts (not shown) extend into apertures 82 formed in the ends of each of the elongated planet gears 78. The bolts secure plates 84 of each assembly 80 to the ends of the planet gears 78. The plates 84 are also secured to counterweights 86 (such as by bolts) to counterbalance the rotating planet gears 78 and portions of the vanes 64 and 66.

Each of the planet gears 78 rocks back and forth between its respective sectors 74 and 76 as the vanes 64 and 66 rock about the hinge pin 68. The elongated planet gears 78 keep the hinge pin 68 rotating in the equatorial plane 23 of the housing 12 as the rotors 42 rotate and the vanes 64 and 66 rotate. The planet gears 78 also act as splines to transfer torque.

The housing sections 14 and 16 contain inlet and outlet ports (not shown). One or more small inlet ports will penetrate the housing 12 near the equator and preferably within 60° from the line contact 58 for the injection of liquid fuel and oxidant.

In FIG. 3, the hinge pin 68 is at the line contact 58 at which time there are two compartments. In FIG. 4, the hinge pin 68 is rotated 90° from the line contact 58 and there are three compartments. Assuming that the illustrated end of the hinge pin 68 is moving downwardly, a working compartment formed by the vanes 64 and 66, the line contact 58 and the housing 12 is expanding in a power stroke. At the same time, a similar compartment on the opposite side of the line contact 58 is contracting in an exhaust stroke. A working compartment defined by the lower surface of the vane assembly 62, as shown in FIG. 4, has reached its maximum volume and is about to enter an exhaust stroke as the opposite end of the hinge pin 68 rises into the exhaust port in the housing 12.

After the hinge pin 68 has moved 60° from the line contact 58, the volume of the compartment formed by the vanes 64 and 66, the line contact 58 and the housing 12 is only about 4% of maximum and, preferably, liquid $NH_3$ and $N_2O$ are injected separately through the inlet port and into this wedgeshaped compartment where they explode spontaneously to raise the temperature and pressure of the gases trapped therein. In this way a power stroke with an expansion ratio of greater than 20 to 1 for high efficiency is started. If fuel injection continues until 90°, the expansion ratio will still be about 8 to 1 for greater power at lower efficiency.

After 180° of hinge pin rotation from the line contact 58, the vanes 64 and 66 are flat and in the plane formed by the axes 25, 54, and 55 and the line contact 58 as shown in FIG. 3. At that point the vanes 64 and 66 span the 60° wide space between the conical faces 56 and the volume of the compartment defined by the vanes 64 and 66, the line contact 58 and the housing 12 has expanded to 62% of maximum. At this time there would momentarily be only two compartments. At this point the vanes 64 and 66 are fully extended from their channels 70 in the rotors 42, but are cantilevered from their opposite ends which are fully embedded in their channels 70 at the line contact 58 and are adequately supported against the diminishing gas pressure.

Between 180° and 270° of hinge pin rotation from the line contact 58, the volume of the compartment continues to expand another 38% before the exhaust stroke begins. During this period of time the compartment is bounded by the faces 56, both ends of the vanes 64 and 66, and the housing 12. From this it can be seen that the strokes can be 270° long in its two-cycle engine for each of the two ends of the vanes 64 and 66.

From the above description it can also be seen that the rotors 42 rotate smoothly at constant velocity about their axes 54 and 55. The tangential velocity of the enos of the hinge pin 68 will only vary by 3.4%.

The vanes 64 and 66 rock into and out of their channels 70 in sinusoidal fashion. In FIG. 3, the vanes 64 and 66 are fully extended and are about to retract into their channels 70, creating their maximum acceleration forces in opposite directions. Consequently, the acceleration forces tend to cancel each other.

The maximum forces occur when the vanes 64 and 66 are directly opposed in the plane of the axes 25, 64 and 55 and there is no tendency for them to buckle at their hinge. At other times the hinge assembly 62 will be folded up 30° out of line at 90° rotation from the line contact 58 as shown in FIG. 4. At this time there is no acceleration. In between the above two limits that portion of the vanes 64 and 66 which extend more than 15° from the faces 56 in the arc 90°–270° will exert acceleration forces toward the equatorial plane 23 of the housing 12 tending to buckle the hinge. However, the ends of the vanes 64 and 66 in the arc 270°–0°–90° will tend to pull away from the equatorial plane 23 of the housing 12 and flatten the hinge so the net buckling effect on the hinge is always zero.

The above-described device is free of unmanageable acceleration forces and operates smoothly as a true rotary engine. Furthermore, the design is simple with a minimum number of components and no valves or cams.

Since intake and compression strokes use half the time in a four-cycle engine, this twocycle engine can deliver two times the power for a given displacement volume.

Since the compression stroke absorbs about one-half of the power stroke energy in a four-cycle engine, by using liquid fuel and oxidant, another factor of 2 improvement can be achieved so that the engine can deliver four times the power for a given displacement that a four-cycle engine would deliver.

Furthermore, the ratio of working volume to overall volume is very favorable due to the compact spherical design without crankshaft, flywheel, crankcase and valve mechanism. Also, no starter is needed.

The fluid power transfer device 10 is shown in the figures as a rotary engine wherein the power stroke is 270° in duration per 360° of rotation of the shafts 24 for each end of the vanes 64 and 66. Consequently, the rotary engine shown is equivalent to a six-cylinder piston engine which would also average 540° of power stroke per shaft rotation. Also, the device 10 could be constructed as a single hemisphere with a flat disc in the equatorial plane.

While the fluid power transfer device 10 has been shown and described as a positive displacement engine in which power is applied to do work by the conversion of specific type of energy into mechanical force and motion, it is to be understood that the fluid power transfer device may also take the form of a displacement pump which draws a working fluid into itself through an inlet port and forces the fluid out through an exhaust port upon rotation of the shafts 24.

While the best mode for carrying out the invention has been described in detail, those familiar with the art to which this invention relates will recognize various alternative designs and embodiments for practicing the invention as defined by the following claims. Particularly, other means for constraining the hinge pin 67 to the equatorial plane 23 can be visualized.

What is claimed is:

1. A fluid power transfer device comprising:

a pair of vanes;

a hinge for connecting the vanes;

a pair of shafts; and a pair of linkages for coupling each of the vanes to its respective shaft, wherein each of the linkages allows its respective vane to oscillate about the hinge and constrains the hinge to rotate in a plane perpendicular to the shafts.

2. The device as claimed in claim 1 further comprising a spherical housing for housing the vanes, the housing having polar axes and an equatorial plane coincident with the plane perpendicular to the shafts.

3. The device as claimed in claim 2 further comprising a pair of rotors received within the housing, said rotors being mounted within the housing for rotation about rotor axes inclined to the polar axes, said vanes causing rotation of the rotors as the shafts rotate, said rotors having conical faces in rolling contact with each other that cooperate with the housing to at least partially define a working chamber in which an operating fluid is received, said vanes extending between the rotors and the housing to divide adjacent portions of the working chamber.

4. The device as claimed in claim 3 wherein the spherical housing has a concave inner surface and wherein each of said vanes has a convex end portion that slides against the concave inner surface of the housing.

5. The device as claimed in claim 3 wherein said rotor axes are inclined with respect to one another.

6. The device as claimed in claim 3 wherein each of said rotors includes a pair of rotor portions and an outer band for holding the rotor portions together, the rotor portions defining a channel extending completely through the rotor and wherein each respective vane is received within its respective channel.

7. The device as claimed in claim 6 wherein said housing has a pair of bearings having grooves formed in their inner surfaces and wherein each outer band is slidably received within its respective groove.

8. The device as claimed in claim 6 wherein each of said outer bands has a continuous conical face that rollingly engages the conical face of the other outer band.

9. The device as claimed in claim 1 wherein each of said linkages includes a pair of gear sectors and a pinion gear operatively received therebetween, one of said gear sectors being fixedly connected to its respective vane and the other of said gear sectors being fixedly connected to its respective shaft.

10. The device as claimed in claim 9 wherein each of said pinion gears has a counterweight attached thereto.

11. A fluid power transfer device comprising:

a spherical housing having an equatorial plane and polar axes;

a shaft mounted for rotation;

a rotor received within the housing;

a vane mounted by the rotor and said rotor being mounted by the housing for rotation about a rotor axis and inclined to the polar axes, said vane causing rotation of the rotor, said rotor having a face that cooperates with the housing to at least partially define a working chamber in which an operating fluid is received, said vane extending between the rotor and the housing to divide adjacent portions of the working chamber; and means coupling the vane to the shaft for substantially constraining rotation of a portion of said vane to the equatorial plane of the housing wherein said vane is guided by the shaft and wherein the vane and the means for constraining transfer power between the operating fluid and the shafts wherein said means for substantially constraining includes gear means operatively associated with said vane to limit said rotation of the portion of said vane to said plane.

12. The device as claimed in claim 11 wherein said gear means includes a pair of gear sectors and a pinion gear operatively received therebetween, one of said gear sectors being fixedly connected to said vane and the other of said gear sectors being fixedly connected to said shaft.

13. The device as claimed in claim 12 wherein said pinion gear has a counterweight attached thereto.

14. A fluid power transfer device comprising:

a spherical housing having an equatorial plane and polar axes;

first and second separate shafts that extend into the housing and are mounted for rotation;

a pair of rotors received within the housing;

first and second vanes and hinge means for hingedly connecting said vanes, said vanes being mounted by the rotors for rotation and said rotors being mounted by the housing for rotation about rotor axes inclined to the polar axes, said vanes causing rotation of the rotors as the shafts rotate, said rotors having faces that cooperate with the housing to at least partially define a working chamber in which an operating fluid is received, said vanes extending between the rotors and the housing to divide adjacent portions of the working chamber; and means coupling the vanes to the shafts for substantially constraining rotation of the hinge means to the equatorial plane of the housing wherein said vanes are guided by their respective shafts and wherein the vanes and said means for constraining transfer power between the operating fluid and the shafts, wherein said means for substantially constraining includes a pair of gear means operatively associated with said vanes to limit rotation of said hinge means to said plane.

15. The device as claimed in claim 14 wherein each of said gear means includes a pair of gear sectors and a pinion gear operatively received therebetween, one of said gear sectors being connected to one of said vanes and the other gear sector being connected to the shaft.

16. The device as claimed in claim 15 wherein each of said pinion gears has a counterweight attached thereto.

17. A fluid power transfer device comprising:

a spherical housing having an equatorial plane and polar axes and having a concave inner surface;

first and second separate shafts that extend through the housing and are mounted for rotation;

a pair of rotors received within the housing, each rotor having bearing surfaces that slide against corresponding surfaces of the housing;

first and second vanes and hinge means for hingedly connecting said vanes, each of said vanes being mounted by its respective rotor for rotation and each of said rotors being mounted by the housing for rotation about a rotor axis inclined to its respective polar axis, each rotor having a conical face that rollingly engages the conical face of the other rotor and cooperates therewith to form a line contact and with their of housing to define a working chamber in which an operating fluid is received, said line contact and vanes extending between the housing and the rotors to divide adjacent portions of the working chamber into at least two working compartments; said vanes causing rotation of the rotors as their respective shafts rotate; and means coupling the vanes to their respective shafts for substantially constraining rotation of the hinge means to the equatorial plane of the housing wherein said vanes are guided by the respective shafts and wherein the vanes and said means for constraining transfer power between the operating fluid and the shafts, wherein said means for substantially constraining includes a pair of gear means, each of said gear means being operatively associated with its respective vane to limit rotation of said hinge means to said plane.

18. The device as claimed in claim 17 wherein each of said gear means includes a pair of gear sectors and a pinion gear operatively received therebetween, one of each of said pairs of gear sectors being connected to its respective vane and the other of each of said pairs of gear sectors being connected to its respective shaft.

19. The device as claimed in claim 18 wherein each of said pinion gears has a counterweight attached thereto.

20. A fluid power device comprising:

a spherical housing having an equatorial plane and polar axes;

a shaft that extends into the housing and is mounted for rotation about one of the polar axes;

a rotor received within the housing;

first and second vanes and hinge means for hingedly connecting said vanes; and means for directly coupling said vanes to the shaft for rotation, said rotor being mounted by the housing for rotation about a rotor axis inclined to the polar axes, said vanes causing rotation of the rotor as the shaft rotates, said rotor having a face that cooperates with the housing to at least partially define a working chamber in which an operating fluid is received, said vanes extending between the rotor and the housing to divide adjacent portions of the working chamber, wherein said vanes are guided by the shaft and wherein the rotor, said means for coupling and the vanes transfer power between the operating fluid and the shaft, wherein said rotor includes a pair of rotor portions and means for holding the rotor portions together, the rotor portions defining a channel extending completely through said rotor and wherein one of said vanes is received within said channel.

21. A fluid power transfer device comprising:

a housing, a portion of which has a spherical concave inner surface with an equatorial plane and polar axes;

first and second separate shafts that extend through the housing and are mounted for rotation about first and second of the polar axes, respectively;

a pair of rotors received within the housing and having bearing surfaces which slide on corresponding surfaces of the housing;

first and second vanes and hinge means for hingdly connecting said vanes; and means for directly coupling each of said vanes to its respective shaft for rotation, each of the rotors being mounted by the housing for rotation about a rotor axis inclined to its respective polar axis, each rotor having a conical face that rollingly engages the conical face of the other rotor and cooperates therewith to form a line contact and with the housing to define a working chamber in which an operating fluid is received, said line contact and vanes extending between the housing and the rotors to divide adjacent portions of the working chamber into at least two working compartments; said vanes causing rotation of the rotors as their respective shafts rotate, wherein said vanes are guided by their respective shafts and wherein the rotors, the means for coupling and the vanes transfer power between the operating fluid and the shafts, wherein each of said rotors includes a pair of rotor portions and means for holding its respective rotor portions together, each pair of rotor portions defining a channel extending completely through its rotor and wherein each of said hinged vanes is received within its respective channel.

22. The device as claimed in claim 21 wherein each of said means for holding has a continuous conical face that rollingly engages the conical face of the other outer band and cooperates therewith to further form the line contact.

* * * * *